United States Patent [19]

Hoang et al.

[11] Patent Number: 4,494,899

[45] Date of Patent: Jan. 22, 1985

[54] PIPE TROUGH FOR TRANSPORTING PIPE BETWEEN UPPER AND LOWER POSITIONS

[75] Inventors: Tan Hoang, Oklahoma City; James B. Smiley, Norman, both of Okla.

[73] Assignee: Tri-Star Enterprises, Inc., Norman, Okla.

[21] Appl. No.: 372,542

[22] Filed: Apr. 28, 1982

[51] Int. Cl.[3] ..... E21B 19/14

[52] U.S. Cl. ..... 414/22; 414/748

[58] Field of Search ..... 414/22, 745, 748, 910; 166/77.5, 85; 175/52, 85; 211/60 S, 1.5

[56] References Cited

U.S. PATENT DOCUMENTS

| | | | |
|---|---|---|---|
| Re. 24,907 | 12/1960 | Maydew | 414/22 |
| 2,201,813 | 5/1940 | Doud | 414/22 |
| 2,335,719 | 11/1943 | Williams | 414/22 |
| 2,448,324 | 8/1948 | Pool | 414/22 |
| 2,631,741 | 3/1953 | Tucker | 414/22 |
| 2,643,006 | 6/1953 | King | 414/22 |
| 2,958,430 | 11/1960 | Robishaw | 414/22 |
| 3,053,401 | 9/1962 | Jinkins, Jr. | 414/22 |
| 3,143,221 | 8/1964 | Blackmon | 414/22 |
| 3,159,286 | 12/1964 | Freeman, Sr. | 414/22 |
| 3,254,776 | 6/1966 | Brown | 414/22 |
| 3,559,821 | 1/1971 | James | 414/22 |
| 3,706,347 | 12/1972 | Brown | 175/85 |
| 3,785,506 | 1/1974 | Crocker et al. | 414/22 X |
| 3,810,553 | 5/1974 | Crocker et al. | 414/22 |
| 3,916,500 | 11/1975 | Brown | 29/240 |
| 4,067,453 | 1/1978 | Moller | 414/22 |
| 4,235,566 | 11/1980 | Beeman et al. | 414/22 |
| 4,345,864 | 8/1982 | Smith, Jr. et al. | 414/22 |
| 4,347,028 | 8/1982 | Dugan | 414/748 X |
| 4,371,302 | 2/1983 | Frias et al. | 414/22 |
| 4,386,883 | 6/1983 | Hogan et al. | 414/22 |

OTHER PUBLICATIONS

Mereco Drawing No. D-10133 and Four Photograph Copies.

Western Gear Corporation Brochure Captioned "Pipemaster", and Photograph.

*Primary Examiner*—Leslie J. Paperner
*Assistant Examiner*—Ken Muncy
*Attorney, Agent, or Firm*—Alan T. McCollom

[57] ABSTRACT

A pipe trough for transporting pipe between upper and lower positions. A pipe carrier having a V-shaped cross-section is received within an elongate trough body having a V-shaped cross-section. The pipe carrier is longitudinally slidable along the trough and is constructed to receive one end of a pipe. A roller is mounted at one end of the trough body for supporting the other end of a pipe received within the carrier. A hydraulic motor is provided for selectively moving the carrier along the length of the trough body. Openings formed crosswise of the trough are distributed along its length. Each opening includes a pipe unloading arm having a pivotal connection to the trough at one side. A ram positioned beneath the arm and having one end pivotally attached to the arm and the other end pivotally attached to the trough is provided for raising and lowering the arm to unload the pipe from the trough. A guard extends downwardly from either side of each unloading arm to conceal the ram when it is in its extended condition.

19 Claims, 30 Drawing Figures

PIPE TROUGH FOR TRANSPORTING PIPE BETWEEN UPPER AND LOWER POSITIONS

BACKGROUND AND SUMMARY OF THE INVENTION

This invention relates to pipe troughs of the kind which are incorporated into apparatus for transporting pipe between a lower position and an upper position.

Past apparatus for handling pipe for transfer between lower and upper positions include dollies for supporting one end of a pipe as it is rolled along a track. Other such apparatus include a pipe trough having an hydraulic ram at one end thereof. The ram includes a rod having a plate mounted at its end for abutment against the end of a pipe. Extension of the ram rod slides pipe along the trough.

Past pipe troughs also include arms for unloading a pipe when the trough is in a lowered condition. The arms are elevatable by a ram positioned beneath each arm. Elevation of the arms ejects the pipe to one side of the trough.

The design of past troughs has been deficient in several respects. The aforementioned rams and dollies for moving pipe longitudinally along the trough have proved insufficient for use with large drilling pipe and casing of the type currently in use for the drilling of deep wells. Furthermore, it has been found that when apparatus for moving pipe longitudinally in the trough is combined with pipe ejecting arms of the kind above described, the arms and rams operating them may be easily damaged by the apparatus for moving pipe longitudinally in the trough.

It is an object of the instant invention to provide a pipe trough having apparatus for moving pipe longitudinally in the trough for use with large and heavy drilling pipe and casing.

It is a more specific object of the invention to provide such apparatus which moves pipe longitudinally in the trough in a stable manner and at an even speed.

It is another object of the instant invention to provide improved pipe unloading arms which conceal the rams operating the arms from damage when the arms are in a pipe-ejecting condition.

The instant invention includes a V-shaped pipe carrier mounted for longitudinal movement in a pipe trough body also having a V-shaped cross-section. The trough body includes an endless loop of chain on each side thereof, such chain being mounted on sprockets at the front and rear ends of the trough body and being power driven by a hydraulic motor. The upper run of each chain is in a channel which includes a slot along its length to permit a flange mounted on the carrier to extend into the channel. Rollers bear against upper and lower surfaces of the channel and each chain is attached to its respective flange. Lateral openings are spaced along the length of the trough. Pipe unloading arms are pivotally attached at one side of each opening to the trough body. A ram is pivotally connected beneath each arm between the trough body and the arm. Ram extension lifts the arm into a pipe-ejecting condition. Downward-extending shields are mounted on either side of each arm thereby shielding each unloading arm's associated ram when the arm is in a pipe-ejecting condition.

These and other objects and advantages of the invention will become more fully apparent when the following detailed description is read in view of the accompanying drawings.

BRIEF DESCRIPTION OF THE DRAWINGS

FIG. 6 is a slightly enlarged view taken along line 6—6 in FIG. 2;

FIGS. 7 and 8 are enlarged views of portions of the pipe racks shown in FIGS. 2 and 6;

FIG. 26 is a right side elevation view of the view of FIG. 23;

FIG. 27 is a left side elevation view of the view of FIG. 23;

FIG. 28 is an enlarged plan view of the front supporting leg of the second embodiment of the invention;

FIG. 30 is a partially schematic view of the second embodiment of the invention showing in dot-dash lines the various positions through which the trough passes when it is raised or lowered.

DETAILED DESCRIPTION OF THE PREFERRED EMBODIMENTS OF THE INVENTION

Figures 1, 2, 3, 4, 5:
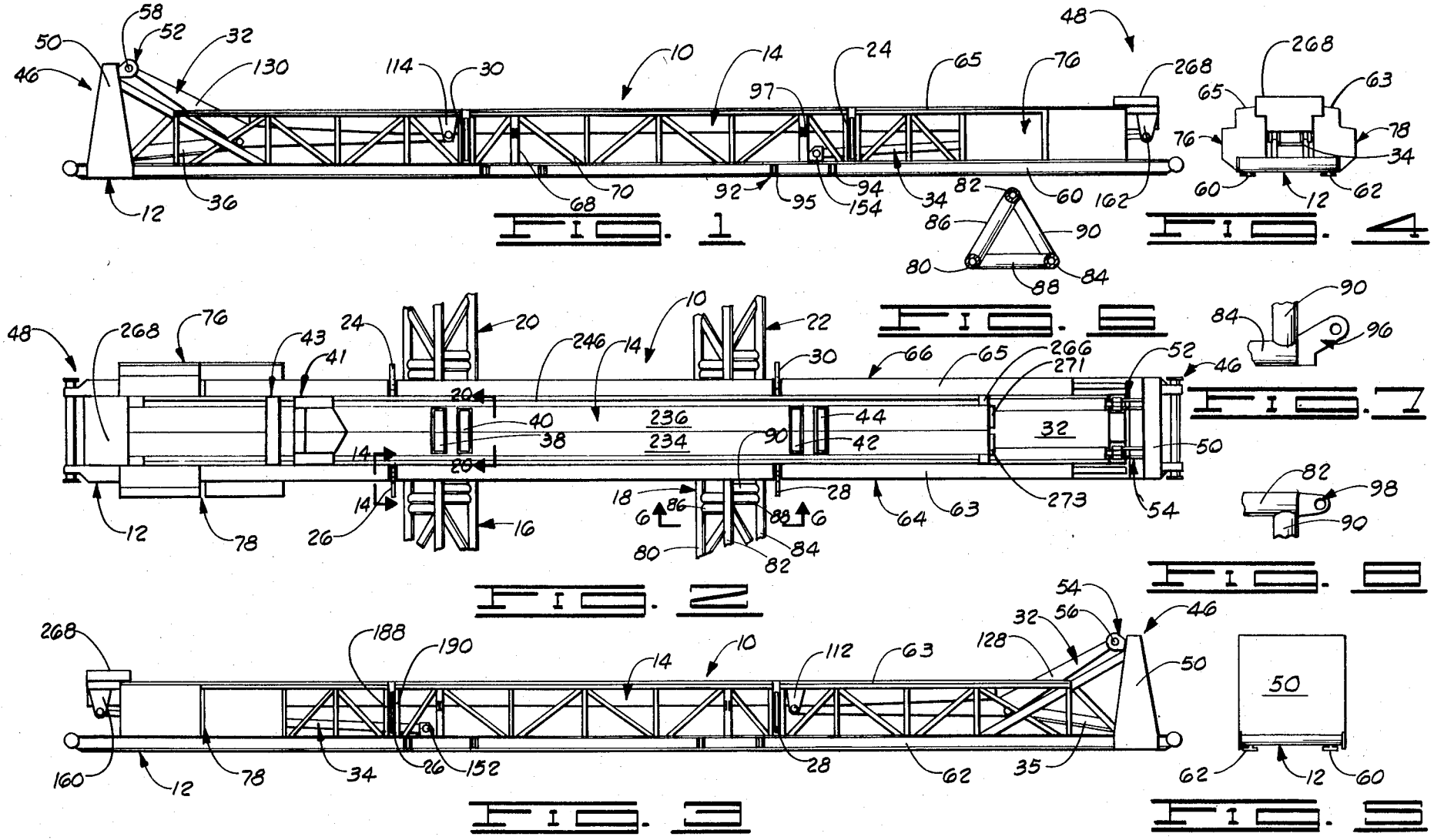
FIG. 1 is a front elevation view of the first embodiment of the invention.
FIG. 2 is a plan view of the view of FIG. 1 including pipe racks.
FIG. 3 is a rear elevation view of the view of FIG. 1.
FIG. 4 is a right side elevation view of the view of FIG. 1.
FIG. 5 is a left side elevation view of the view of FIG. 1.

Turning now to the drawings and particularly to FIGS. 1–5, indicated generally at 10 is a machine including a preferred embodiment of the invention. Included therein is a base 12 and a trough 14 received within and supported by the base. Pipe racks 16, 18, 20, 22 are mounted on either side of the base and extend laterally therefrom.

As will later become more fully apparent, pipe loading arms 24, 26, 28, 30 lift a pipe supported by the pipe racks from the racks into trough 14. A front support leg 32 and a rear support means or leg 34 are each pivotally connected at one end to the trough and at the other end to base 12. Hydraulic rams 35, 36, when extended, lift the trough on its legs from the base into the air as can best be seen in FIG. 22. A pipe carrier 41 is used for sliding pipe along the length of the trough to enable unloading the pipe when the trough is in its upper position. A stop bar 43 serves to limit rearward travel of the pipe carrier and, as will later become more apparent, to eject pipe from the pipe carrier.

In the instance when pipe is loaded into the trough at its upper position for transport to a lower position, unloading arms 38, 40, 42, 44 are provided for ejecting the pipe from the trough onto the pipe rack when the trough is lowered onto the base as shown in FIGS. 1 and 2.

Base 12 includes a front end indicated generally at 46 and a rear end indicated generally at 48. An upright pedestal 50 spans the width of the base at front end 46. Included at the top portion of pedestal 50 are a pair of shoes 52, 54. Conventional shoes 52, 54 receive a pin 56 in shoe 54 and a pin 58 in shoe 52 in order to provide a pivotal connection between front leg 32 and pedestal 50.

Figure 17:
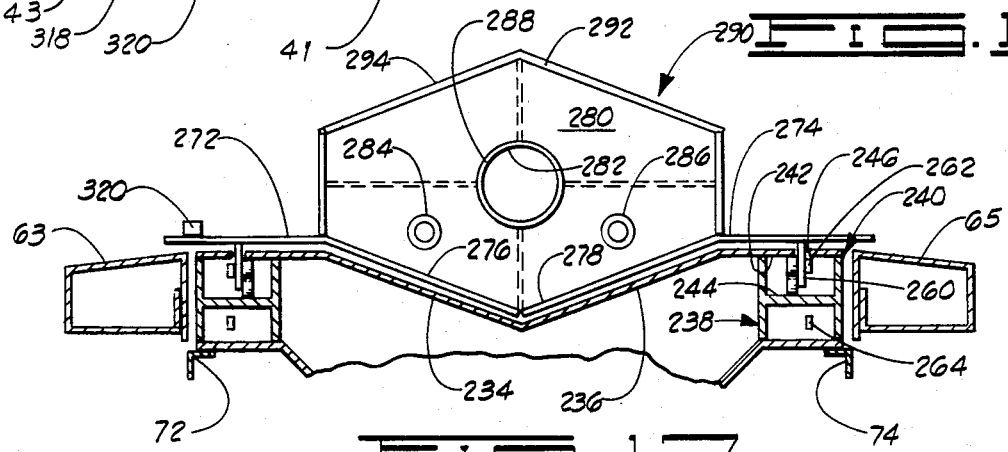
FIG. 17 is a view taken along line 17—17 in FIG. 16.
Figure 18:
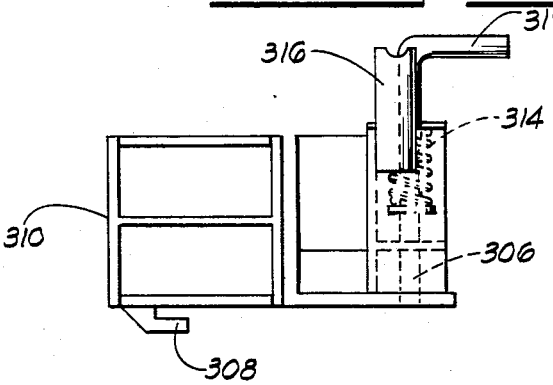
FIG. 18 is an enlarged view taken along line 18—18 in FIG. 16.
Figure 20:
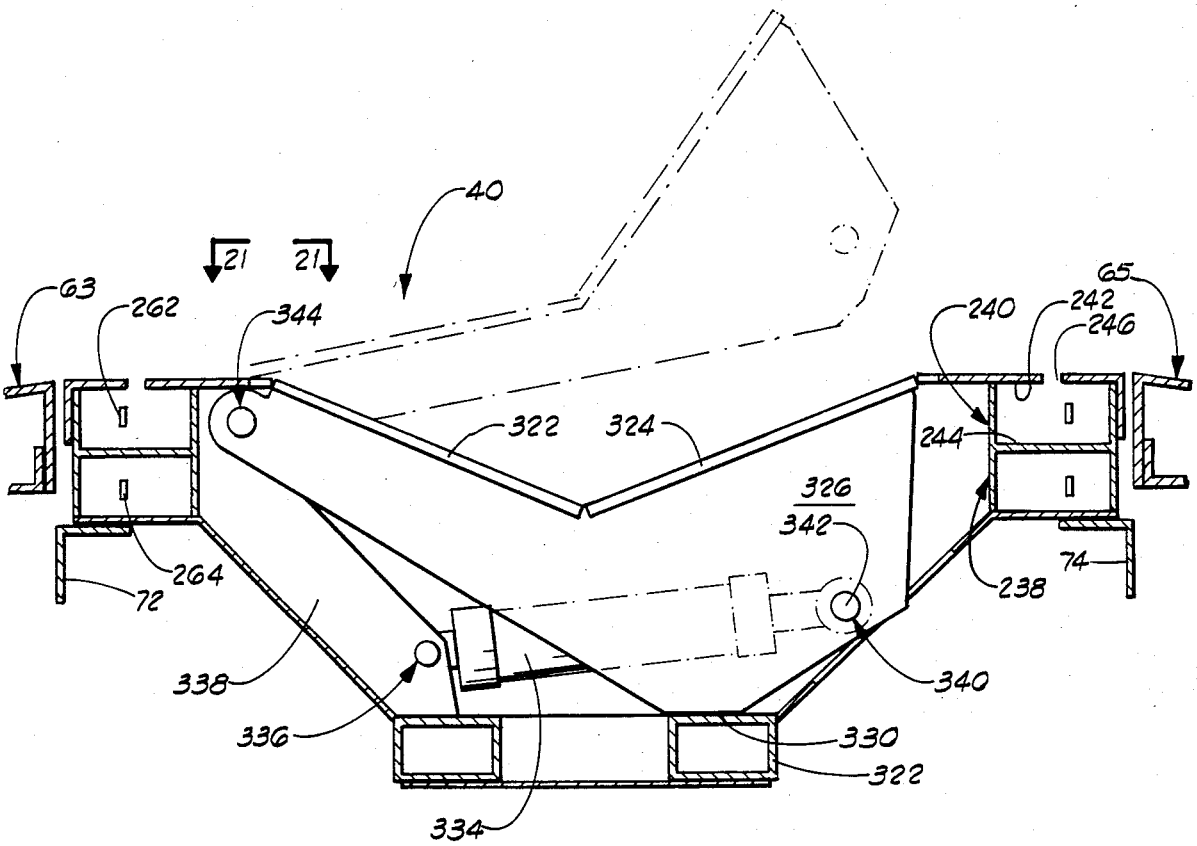
FIG. 20 is an enlarged view taken along line 20—20 in FIG. 2.

The lower portion of base 12 includes a pair of I-beams 60, 62. Each I-beam is attached to the pedestal and extends along the length of the machine. A pair of side walls 64, 66 extend upwardly from each I-beam 62, 60, respectively. Each side wall includes vertical and angled struts like struts 68, 70 in FIG. 1. Also included in each sidewall are rails 72, 74 (shown in FIGS. 17 and 20). Rails 72, 74 are mounted on the struts and extend along the length of the trough to support it when the trough is in its lowered position (the position of FIG. 1). Included at the top of each side wall 64, 66, and supported by the struts in each wall, is a pipe ramp 63, 65, respectively. Pipe ramps 63, 65 are also shown in FIGS. 17 and 20. The pipe ramps extend along the top of each side wall adjacent the trough when the trough is in the position of FIG. 1. As will later become more fully apparent, the ramps serve to facilitate unloading of pipe from trough 14 onto the pipe racks.

Built into the base near rear end 48 are cabinets 76, 78. Cabinet 76 is built into the rear end of side wall 66 at the rear of the machine on I-beam 60. Cabinet 78 is likewise built opposite cabinet 76 on I-beam 62. Each of the cabinets serve to house necessary hydraulic tanks and controls which are used to operate the machine.

Included in each pipe rack are three elongate members like members 80, 82, 84 in pipe rack 18. The members are maintained in parallel relationship to one another by spacing members 86, 88, 90 which are welded to the elongate members. Similar members are welded in the same configuration at regular intervals along the length of the rack.

Indicated generally at 92 in FIG. 1 are what is referred to herein as means for securing the pipe racks to the base. Included therein are three sets of parallel plates 94, 95, 97. Each of the plate sets is positioned so that when a pipe rack is positioned in front of the sets with its axis normal to the longitudinal axis of the base, each of the plate pairs line up with a pinnable connection, like connections 96, 98 in FIGS. 7 and 8 on the pipe rack. Although the connections only for members 82, 84 are shown, such connecting to plates 94, 97, it is to be appreciated that the connection for member 80 is formed opposite to connection 96 so that each of the three connections on the end of the rack fit between each set of plates 94, 95, 97. Each of the sets of plates includes a hole therethrough which is located to align with the holes in each of the three connectors to permit pinning the pipe rack to the base. As will later be seen, such connections enable the pipe racks to stabilize the machine and to provide support for pipes waiting transport to or from pipe trough 14.

Figure 9:
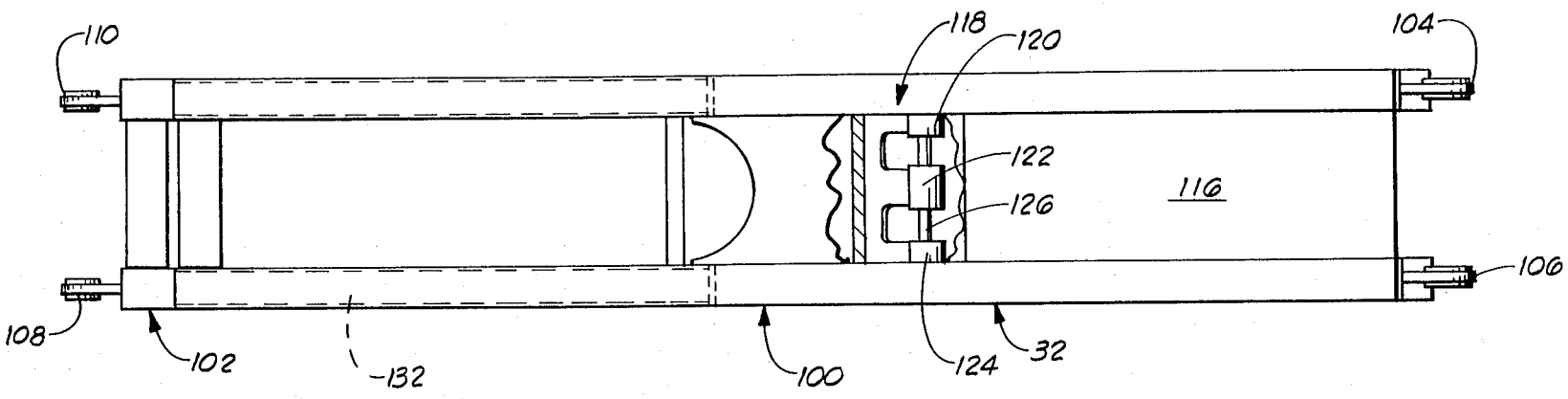
FIG. 9 is an enlarged plan view of the front supporting leg of the embodiment of the invention shown in FIGS. 1–5.
Figure 10:
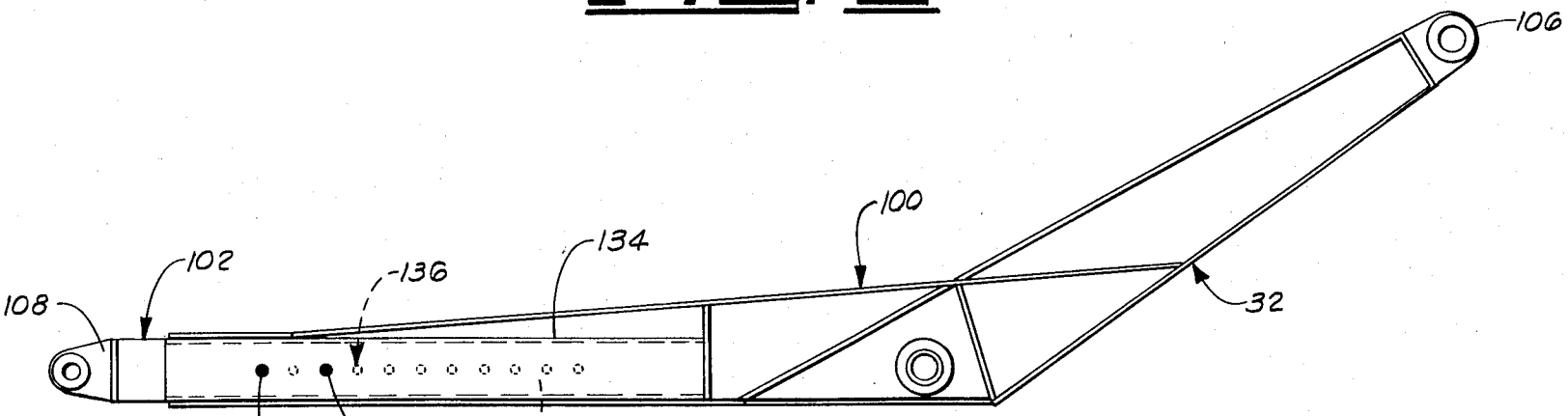
FIG. 10 is a front elevation view of the view of FIG. 9 with a side panel removed.

Turning now to FIGS. 9 and 10, front leg 32 includes a bottom section 100 and a top section 102 received within the bottom section. Bottom section 100 includes eyes 104, 106 formed at one end thereof to provide a pivotal attachment between the front leg via eyes 104, 106 to shoes 52, 54, respectively, on pedestal 50. Eyes 108, 110 are formed in the top section to permit pivotal engagement with trough 14 at a trough shoe 112 (in FIG. 3) and a trough shoe 114 (in FIG. 1), respectively. A panel 116 (a portion of which is broken away) covers a pivotal connection indicated generally at 118 which is used to attach rams 35, 36 to leg 32. Tubular portions 120, 122, 124 receive a shaft 126. Rams 35, 36 are of conventional construction and include a rod extending therefrom having an eye mounted on the end of the rod. When shaft 126 is withdrawn longitudinally from the tubular portions, the eye on ram 35 is fitted between tubular portions 122, 124 while the eye on ram 36 is fitted between portions 120, 122. When shaft 126 is reinserted, the rams are pivotally engaged to leg 32.

In a similar manner, each of the other ends of the rams are pivotally secured to the base at the bottom of the pedestal.

In FIG. 3, leg 32 includes a panel 128 which has been removed to provide the view of FIG. 10. A similar panel 130 is mounted on the laterally outer portion of the other side of front leg 32 and covers structure opposite and symmetrical to that shown in the view of FIG. 10.

In FIG. 10, top section 102 includes a beam 132 having a square cross-section. Beam 132 is received within a slightly larger beam 134. Beam 132 is slidable within beam 134 and may be fixedly secured thereto with a pair of bolts inserted into holes 136 formed in beam 132. In the position of beam 132 shown in FIG. 10, holes 138, 140 are lined with a pair of holes in beam 134 and in panel 128 (not shown). Thus, the length of the top portion of leg 32 may be varied by selectively positioning holes 136 in the position of holes 138, 140 and by inserting and fastening a bolt through the aligned holes. Beam 134 includes what is referred to herein as a first piece while beam 132 comprises a second piece, both pieces together comprising length adjustment means. Leg 32 between eyes 104, 106 and shaft 126 is referred to herein as a first portion of the leg. Leg 32 between shaft 126 and eyes 108, 110 is referred to herein as a second portion of the leg.

Figure 11:
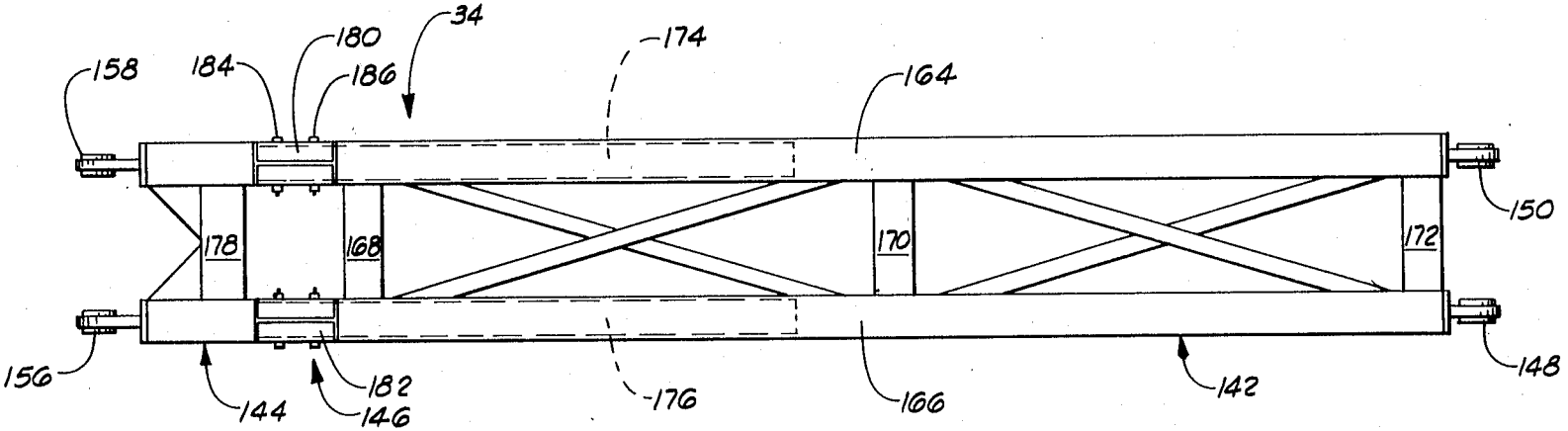
FIG. 11 is a plan view of the rear supporting leg in the first and second embodiments of the invention.
Figure 12:
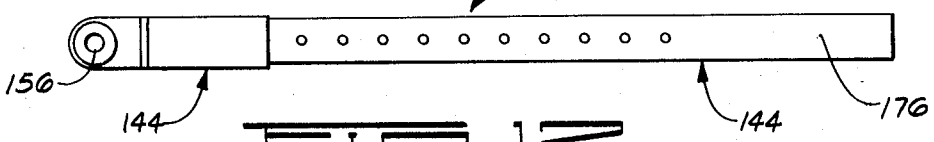
FIG. 12 is a front elevation view of the top portion of the rear supporting leg of FIG. 11.
Figure 13:
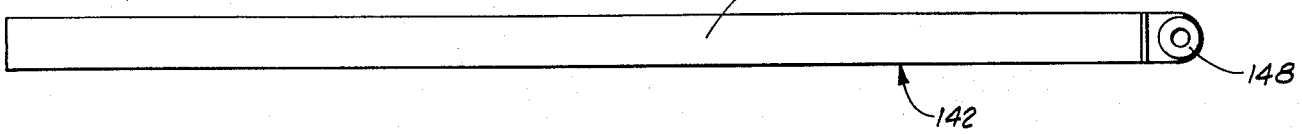
FIG. 13 is a front elevation view of the bottom portion of the rear supporting leg of FIG. 11.

Turning now to FIGS. 11–13, illustrated therein is the rear support means or leg 34. Included therein is a first or bottom member 142, a second or top member 144, and indicated generally at 146, stop means. The bottom member includes a pair of eyes 148, 150 which are pivotally attached to base 12 (in FIGS. 1 and 3) via base shoes 152, 154, respectively. This pivotal connection between rear support leg 34 and the base is referred to herein as a first pivotal connection.

Eyes 156, 158 are mounted on the top section and provide a means for pivotally attaching the rear leg to the trough via rear trough shoes 160, 162, respectively. This pivotal connection of the rear leg to the rear end of the trough is referred to herein as a second pivotal connection.

Included in bottom member 142 are a pair of beams 164, 166 which are maintained in spaced-apart parallel relation by studs 168, 170, 172 which are welded to each beam in the position shown in FIG. 11. Top member 144 likewise includes a pair of beams 174, 176 being of a size to just fit into beams 164, 166, respectively. Beams 174, 176 are connected together by a stud 178, such being welded therebetween. Stop means 146 includes a pair of collars 180, 182 which fit around and are bolted to beams 174, 176, respectively. As can be seen in FIG. 12, beam 176 (as well as beam 174) include a plurality of holes 185 to permit bolting collars 180, 182 to a selected position opposite one another along beams 174, 176. Collar 180 is bolted to beam 174 via bolts 184, 186 and collar 182 is bolted to beam 176 in a similar manner.

As will later become more fully apparent, in the operation of the machine, top member 144 slides into and out of bottom member 142 to enable lifting and lowering of the rear portion of trough 14. Placement of collars 180, 182 limit the inward telescopic movement of beams 174, 176 into beams 164, 166, respectively.

Figure 15:
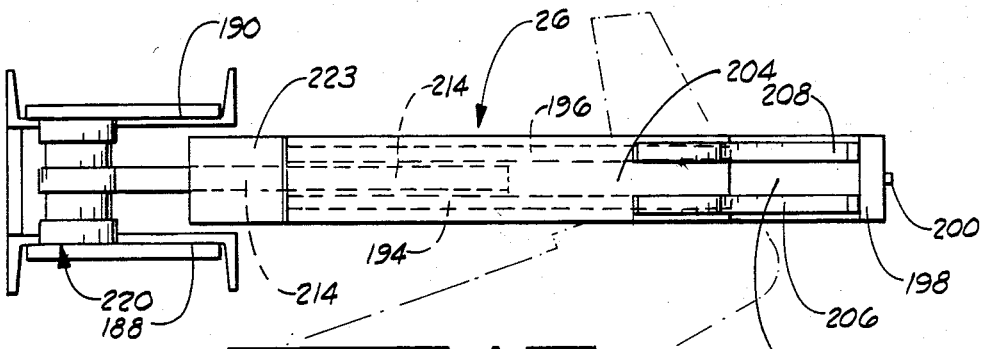
FIG. 15 is a plan view of the view of FIG. 14.
Figure 14:
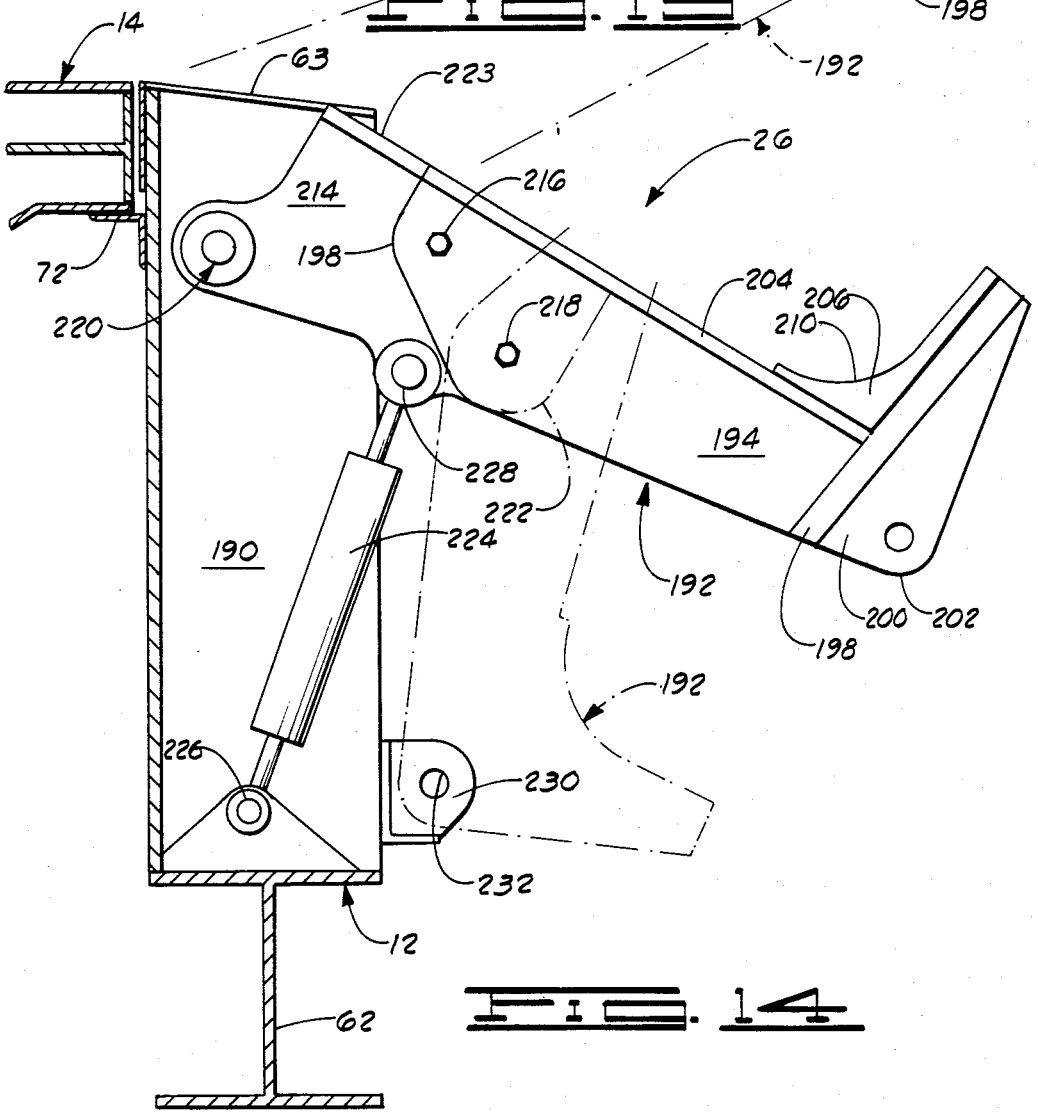
FIG. 14 is an enlarged view taken along line 14—14 in FIG. 2 with the loading arm in a lowered position and with the stored and raised positions of the loading arm shown in dot-dash lines.

Loading arm 26, in FIGS. 2 and 3, is mounted between a pair of upright struts 188, 190 which support the mounting arm as well as pipe ramp 63. For a more detailed description of the structure in loading arm 26, attention is directed to FIGS. 14 and 15. Although only the structure contained in loading arm 26 is described herein, it is to be appreciated that each of the other pipe loading arms 24, 28, 30 are constructed and function in a similar manner. Pipe loading arm 26 includes a pick-up arm 192. Included in arm 192 is a pair of spaced-apart plates 194, 196. Plates 194, 196 are of the same size and dimensions. Each has a top edge, like edge 198 of plate 194. The lower edge of each plate 194, 196 is connected to a pick-up bar 198. A securing flange 200 is mounted beneath the bar along the length thereof and a hole 202 is formed in the securing flange. Mounted along the upward facing edge of plates 194, 196 is a flange 204. Flange 204 is substantially planar and is rectangularly shaped. A pair of pipe cradles 206, 208 are mounted both to flange 204 and to pick-up bar 198 at the juncture of flange 204 and the bar. Each cradle includes a curved upward facing surface, like surface 210 on cradle 206 which, as will later become more apparent, serves to lift a pipe off of the pipe rack.

Pick-up arm 192 is mounted on a mounting arm 214 via a pair of bolts 216, 218. The mounting arm is pivotally attached between upright struts 188, 190 with a conventional pivotal connection 220. The lower portion of mounting arm 214 extends between plates 194, 196 and includes a pair of holes to permit passage of bolts 216, 218 therethrough. Mounting arm 214 includes a lower edge 222 beneath bolt 218. An upward facing edge of the mounting arm includes a flange 224 which abuts against flange 204 and is similar to 204 except that it is shorter in length. A conventional ram 223 is pivotally connected at one end to base 12 via a conventional pivotal connection 226 and at the other end to mounting arm 214 via a conventional pivotal connection 228. An eye 230 is mounted on base 12 as shown and includes a hole 232. When the ram is actuated, its length extends in a conventional manner to pivot mounting arm 214, and hence pick-up arm 192, into its upper condition shown in dot-dash lines above the solid-line view of the arm. When the ram is in its contracted condition, the pick-up arm assumes the position shown in solid lines.

When it is desired to ship the machine, in order to prevent damage to the arm and to lessen the maximum width of the machine, bolt 216 is removed and pick-up arm 192 is pivoted about bolt 218 into a lowered position shown in dot-dash lines. When the pick-up arm is so lowered, a bolt is run through hole 202 on flange 200 and through hole 232 in eye 230 and is secured to maintain the pick-up arm in its lowered position.

Although not shown in the drawings, additional pick-up arms having different lengths and/or differently shaped pipe cradles, like cradle 206 on pick-up arm 192, may be attached to mounting arm 214. By unbolting bolts 216, 218 and mounting a different arm having plates, like plates 194, 196, on the mounting arm, different sizes and weights of pipe or casing may be handled by the pick-up arms.

For a more detailed examination of the structure of pipe carrier 41, stop bar 43, and trough 14, attention is directed to FIGS. 16–19. Trough 14 includes a V-shaped cross-section. This portion of the trough is formed by a pair of downward-sloping panels 234, 236 which extend along the length of the trough and are joined together along one edge of each panel. On each side of the trough, a pair of upper and lower channels like channels 238, 240 extend along the length of trough 14. Channel 240 includes a downward facing surface 242 and an upward facing surface 244. A slot, like slot 246, extends along the upper portion of each upper channel.

In FIG. 2, elongate rollers 271, 273 are mounted on the end of each panel 236, 234, respectively. Each roller raises above the surface of its associated panel, and as will later be seen, serves to support a pipe contained within the trough.

Figure 19:
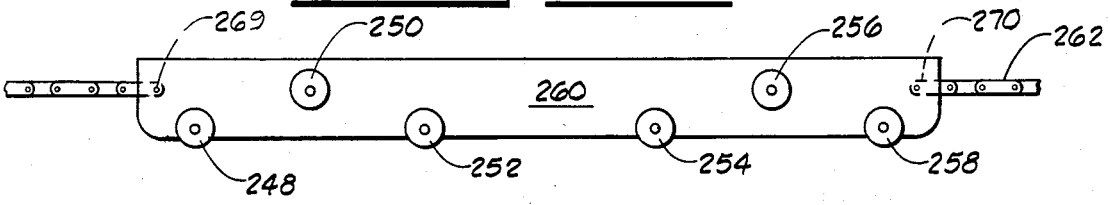
FIG. 19 is an enlarged view taken along line 19—19 in FIG. 16.

In FIG. 19, cams or rollers 248, 250, 252, 254, 256, 258 are mounted on a carrier support means or downward extending flange 260. Rollers 250, 256 bear upwardly against surface 242 while the remainder of the rollers bear downwardly against surface 244.

Each of the channels includes a run of chain along the length thereof, like chains 262, 264. In FIG. 2, chain runs 262, 264 are actually part of an endless loop of chain which loops around a sprocket (not shown) contained beneath a trap door 266 and a sprocket mounted on an axle which spans a rear motor housing 268 (in FIG. 2) mounted at the rear end of trough 14. Contained within housing 268 is a hydraulic motor which rotates the axle upon which sprockets are mounted, one at either side of the trough, in order to drive an endless loop of chain along the channels on each side of the trough. Since each chain is secured to its respective flange upon which the rollers are mounted, as in connections 269, 270 in FIG. 21, running the motor in one direction moves the flanges one way and running it in the other direction moves the flanges the other way.

Each of the flanges, like flange 260, comprise a part of pipe carrier 41 and each flange is connected to what is referred to herein as pipe carrier wings 272, 274. The wings are connected to carrier panels 276, 278 which parallel trough panels 234, 236. A bevel 237 is formed on the front edge of each panel 276, 278. An upright portion 280 is diamond-shaped but with either lateral point on the diamond being cut off normal to the diamond's horizontal axis. A bore 282 is formed at the center of portion 280. Springs 284, 286 are mounted on portion 280 and face toward the front of the trough. A tubular portion 288 extends from bore 282 toward the rear of the trough.

An upper portion 290 includes panels 292, 294. Portion 290 is detachable and as will later be seen, may be removed in certain modes of operation. Extension means or bumper block 296 is shown in exploded view, bumper block 296 being extended out of pipe carrier 41 toward the front of the trough. Bumper block 296 includes a tubular portion 298 and a planar portion 300. Planar portion 300 is in the same cut-off diamond configuration of portion 280 except that it is slightly smaller to permit it to fit beneath upper portion 290. Included in planar portion 300 is a metal plate 302 and a wooden slab 304, each of which are shaped in the previously described configuration.

In operation, portion 298 is received within portion 288 on pipe carrier 41. As will later become apparent, when tubular portion 298 strikes bar 43 as pipe carrier 41 moves toward the bar, a pipe contained within the carrier is pushed toward the front of the trough so that the end of the pipe is no longer covered by upper portion 290.

Bar 43 spans the trough at the height of bore 282 in the pipe carrier. The bar includes a post 306 and a hook 308 on each end of the bar. A front surface 310 faces the front of the trough and the rear of pipe carrier 41. Although not illustrated, a series of holes and slots extend along each side of the trough beneath hook 308 and post 306 and are spaced to permit hook 308 to fit into a slot and post 306 to be received within a corresponding hole. Post 306 includes a top portion 312 which extends substantially normally from post 306. A spring 314 biases the post downwardly so that it is maintained within its hole in the trough. A support 316 is provided to permit top portion 312 to be received on the top of support 316 thereby maintaining post 306 out of the hole. In this condition the bar may be moved to a selected spot along the trough and reset by rotating top portion 312 to permit the spring to bias post 306 downwardly.

Figure 16:
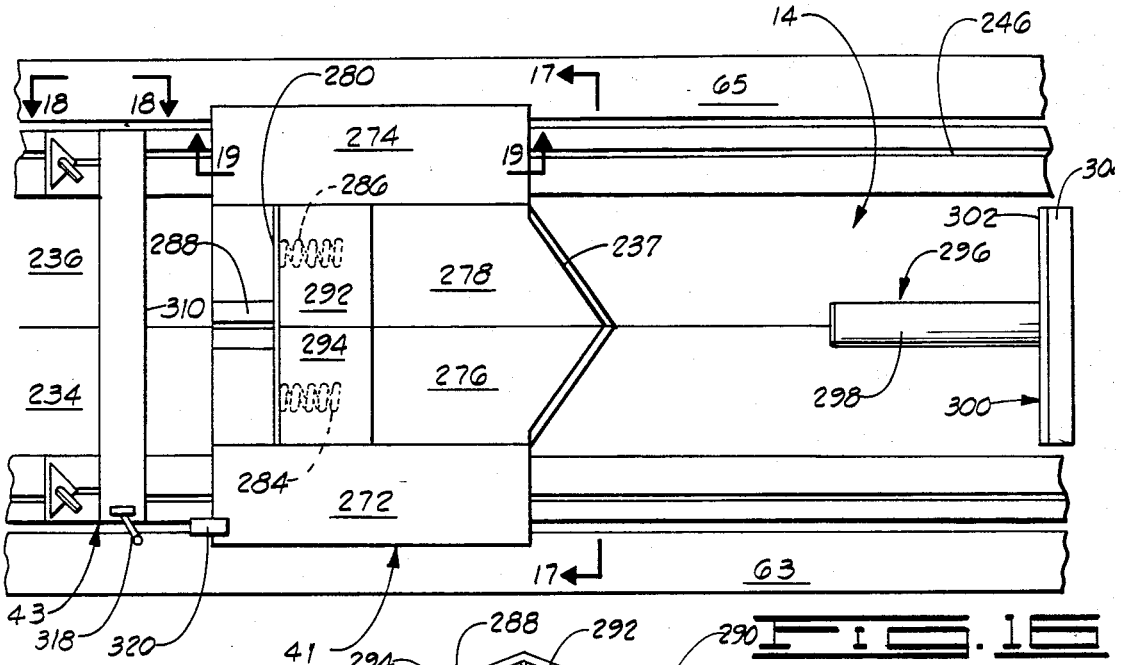
FIG. 16 is an enlarged portion of the view of FIG. 2 showing the pipe carrier and an exploded view of the plunger.

A switch 318 is mounted on one end of bar 43. An actuator 320 is mounted on one side of pipe carrier 41 as shown in FIG. 16. The switch and the actuator are in alignment and, when pipe carrier 41 moves against the stop bar to permit bumper block 296 to be extended (thereby ejecting a pipe from the carrier), the switch is switched to prevent further rearward travel of pipe carrier 41.

Figure 21:
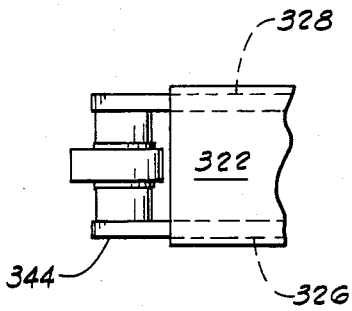
FIG. 21 is a portion of a view taken along line 21—21 in FIG. 20.

Unloading arms 38, 40, 42, 44 are each of similar construction and are typified by the structure shown for unloading arm 40 in FIGS. 20 and 21. Each of the unloading arms is recessed in a lateral opening formed across the trough in panels 234, 236. Unloading arm 40 includes panel portions 322, 324. Panel portions 322, 324 are joined to form a V-shaped cradle which is in alignment with panels 234, 236 of the pipe trough when unloading arm 40 assumes the solid-line configuration shown in FIG. 20. Guard means or planar portions 326, 328 extend downwardly along either edge of panel portions 322, 324. Each planar portion includes a lower edge, like edge 330 on planar portion 326 which rests on a support or beam 332 that forms a part of the underside of trough 14. A ram 334 includes a pivotal connection 336 at one end thereof to an upright plate 338 which forms a part of trough 14. The other end of the ram includes a pivotal connection 340 on a shaft 342 which extends between planar portions 326, 328. A pivotal connection 344 between planar portions 326, 328 and upright plate 338 permit upward pivoting of the unloading arm to the position shown in dot-dash lines above the solid-line position.

In FIG. 2, it can be seen that unloading arm 40 pivots upwardly to eject pipe along pipe ramp 63 to pipe racks 16, 18. Unloading arm 44 likewise ejects pipes in the same direction and, as will later be seen, when it is desired to eject a pipe from the trough toward the side of the machine where ramp 63 is located, arms 40, 44 are pivoted together to achieve that result. On the other hand, when it is desired to eject the pipe on the other side of the machine, unloading arms 38, 42 are used, each of which is pivotally connected to an upright plate, like upright plate 338 which is located on the ramp 65 side of the machine. Thus, simultaneous pivoting of arms 38, 42 ejects pipe toward ramp 65 onto pipe racks 20, 22.

Figure 22:
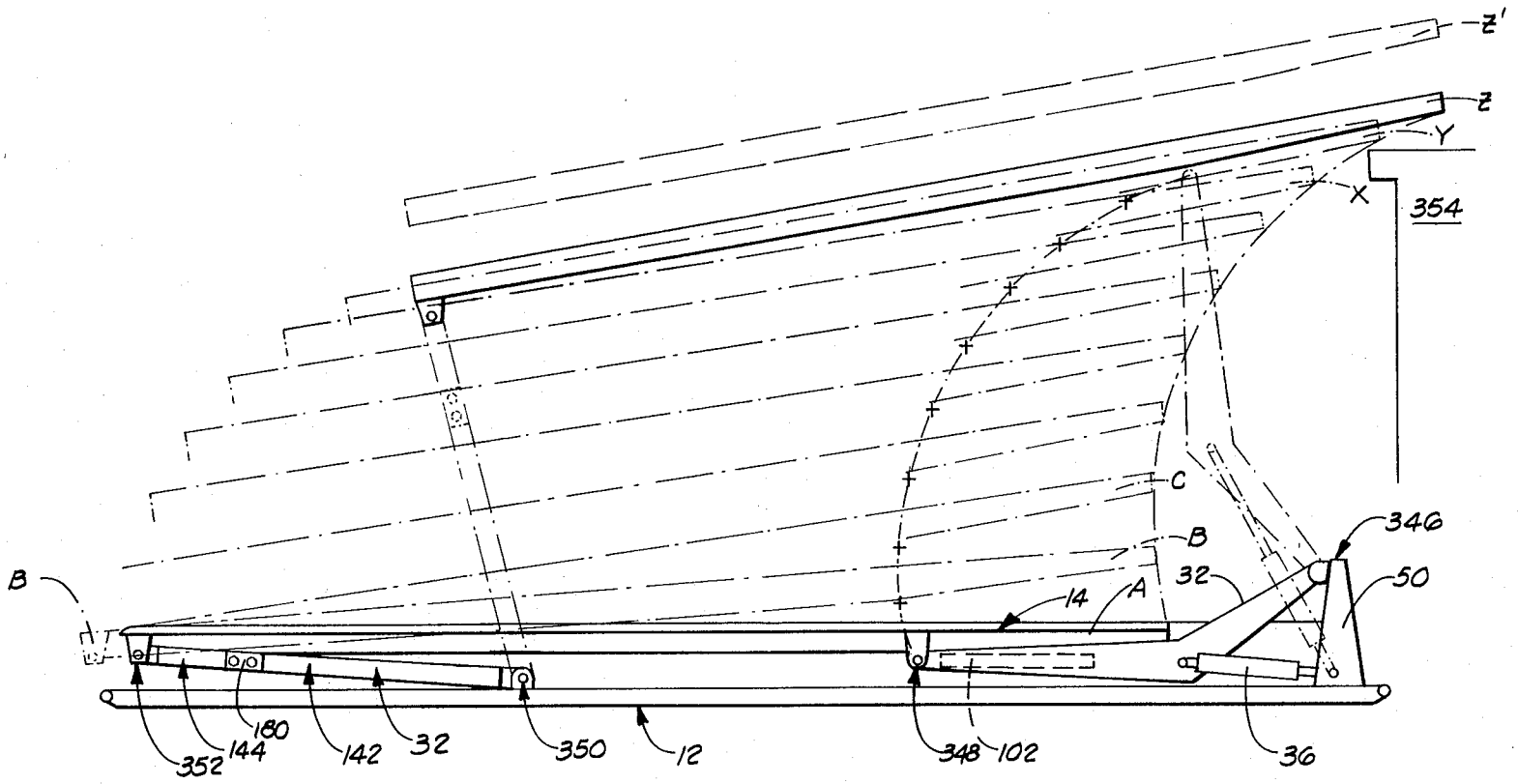
FIG. 22 is a partially schematic view of the first embodiment of the invention showing in dot-dash lines the various positions through which the trough passes when it is raised or lowered.
Figure 23:
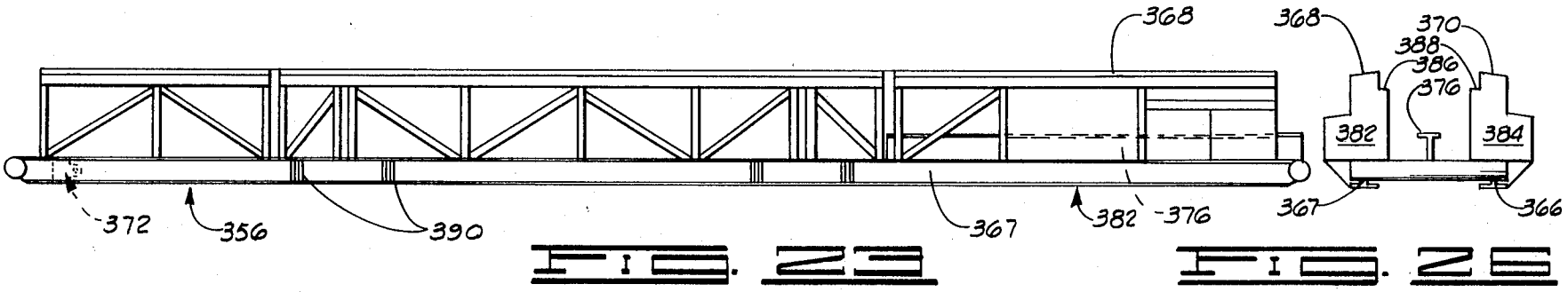
FIG. 23 is a front elevation view of the base of the second embodiment of the invention.

FIG. 22 illustrates several of the positions which the machine passes through as it changes from a lowered condition to a raised condition. The letters A, B, C, X, Y, Z are used to designate several such positions. As will be recalled, leg 32 includes a pivotal connection, indicated at 346, to base 50 as well as a pivotal connection, indicated at 348, to trough 14. Likewise, rear leg 32 includes a pivotal connection 350 to base 12 and a pivotal connection 352 to trough 14. The machine is shown adjacent a platform 354 from and to which pipe is to be transported.

In operation, and referring now to FIGS. 1–5, pipe is initially laid across pipe racks 16, 18, and across pipe racks 20, 22 so that the longitudinal axis of the pipe is parallel to the axis of the machine. Next, by way of example, pick-up arms 24, 30 are each actuated so as to pick up one piece of pipe from the rack. As each arm raises, the curved surface (like surface 210 on pipe cradle 206) on each of the pick-up arms lifts the pipe and as the arms continue to raise, the pipe rolls along the flanges on each arm (like flanges 204, 224 on arm 26) and into pipe trough 14. Although numbers used refer only to loading arm 26, as has been previously mentioned, each of the other pipe loading arms includes similar structure.

After the pipe is loaded into the trough, fluid is introduced into rams 35, 36. Initially, the front end of trough 14 begins upward movement while the entire trough also moves slightly to the rear as the trough moves from position A to position B. When the trough is in position B, connections 346, 348, 352 are aligned and thus the trough is at its maximum rearward extension. This rearward movement is permitted due to top section 144 being telescopingly received within bottom section 142 of rear leg 32. As upward and forward movement continues from position B due to additional extension of the rams, when trough 14 reaches position C, collar 180 abuts against bottom section 142. Any additional movement after collar 180 abuts against bottom section 142 causes upward pivoting of rear leg 32. Once collar 180 is against bottom section 142, no further inward telescopic action is possible and, when front leg 32 continues its upward and forward movement, the rear leg ultimately pivots to the position shown in dot-dash lines in FIG. 22.

Due to the great amount of vertical movement of trough 14 over a relatively short horizontal distance, it is possible to unload pipe from any of positions X, Y or Z. For example, in the case of an extremely heavy casing for a big well, which may weigh several thousand pounds, it may be desirable to stop at position X. Thereafter, the hydraulic motor in motor housing 268 which powers pipe carrier 41 is actuated and the pipe carrier begins forward movement to the front of the trough against the base of the pipe thereby pushing the pipe end onto platform 354. A winch (not shown) on platform 354 may then be used to pull the pipe onto the platform. Alternatively, in the case of lighter weight pipe, it may be desirable to move to position Y or Z and to attach the platform winch onto the end of the pipe thereby lifting the pipe vertically upward and permitting the lower end of the pipe to swing off the end of the trough.

After unloading of the pipe, fluid is evacuated from rams 35, 36 to permit the trough to return to position A for loading another pipe.

When it is desired to move pipe from platform 354 to the level of the machine, the empty pipe trough is raised to position X, Y or Z to permit loading of a pipe into the trough. In the unloading operation, bumper block 296 is received within tubular portion 288 of pipe carrier 41 (in FIG. 16). The end of the pipe first into the trough is lowered until it is received within and supported by the pipe carrier under covered portion 290 and abuts slab 304. The pipe is further lowered until it is supported at the front end of the trough by rollers 271, 273. After lowering the trough to position A, the hydraulic motor powering the carrier is activated to drive the carrier to the rear of the trough. When the carrier reaches bar 43, tubular portion 298 strikes the bar and is pushed forward with respect to carrier 41 thus pushing the pipe out from beneath covered portion 290. Shortly thereafter, actuator 320 strikes switch 318 thus cutting power to the motor.

The operator now selects toward which side of the machine to eject the pipe. If onto pipe racks 20, 22 the hydraulic rams operating unloading arms 38, 42 are actuated thus raising the arms to the dot-dash lines position shown in FIG. 20 for arm 40. If, on the other hand, unloading onto racks 16, 18 is desired, the rams powering arms 40, 44 are actuated thus pushing the pipe onto the racks.

It may be desirable to slightly elevate the loading arms on the side of the machine toward which the pipe is being unloaded. The unloading arms may serve to catch pipe as it leaves the machine and thereafter, lowering of the loading arms sets the pipe back on the pipe racks.

The planar portions on the loading arms like portions 326, 328 on arm 40, serve to protect the ram when the arm is in its elevated position. When a pipe is first loaded into the trough for lifting to platform 354, it is possible to introduce a small amount of fluid into each of the rams controlling unloading arms 38, 40, 42, 44. Thus, arms 38, 40, since they lift in opposite directions, tend to slightly elevate the pipe from panels 236, 234. Arms 42, 44 likewise slightly lift the pipe. With the pipe in a slightly lifted position, it is possible to drive pipe carrier 41 under one end of the pipe. Portions 236, 238 on each of the arms thus protect the ram, when the arm is in a raised condition, from being inadvertently hit by the pipe carrier.

Position Z', shown in dashed lines, illustrates the maximum height of trough 14 when collars 180, 182 are bolted into the holes, like holes 185, in the upper portions of the rear leg to achieve maximum height of the rear leg when in a raised position. Likewise, the top sections of the front leg are bolted at their outermost positions, as by holes 136 in top section 102, to obtain maximum height of the front leg. Due to the selection of holes in both rear and front legs, the trough may be adjusted to achieve heights which vary by six-inch increments between position Z and Z'.

Figure 24:
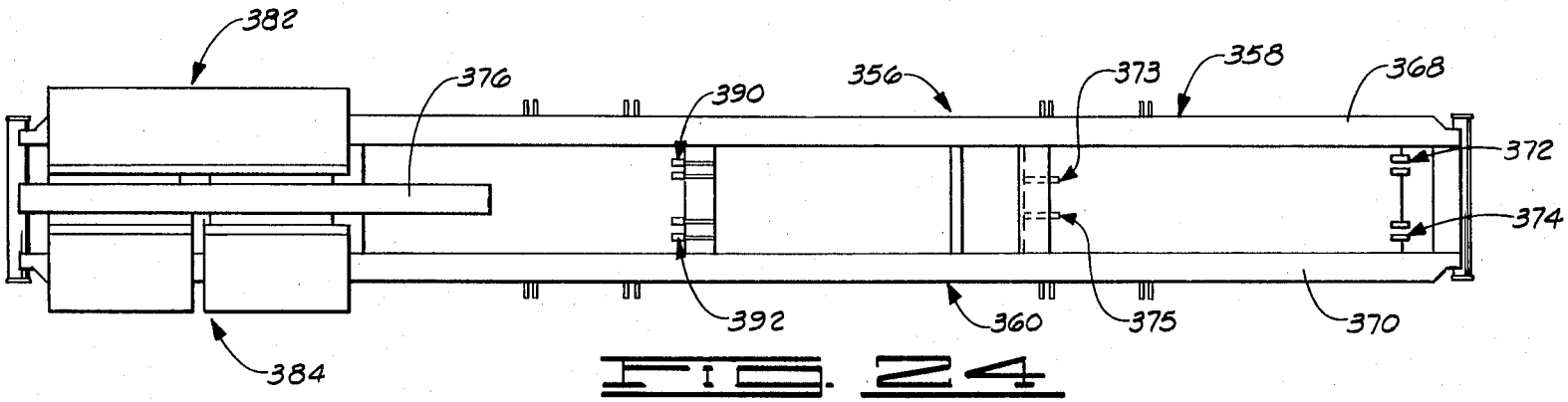
FIG. 24 is a plan view of the view of FIG. 23.

Description will now be made of a second embodiment of the invention. Indicated generally at 356 in FIG. 24 is a base for use with the second embodiment. Like base 12 in the first embodiment (FIGS. 1–5), base 356 includes a pair of side walls 358, 360. Vertical and diagonal bracing struts, like struts 362, 364 in side wall 360 extend upwardly from an I-beam 366. Similar struts extend upwardly from I-beam 367 in the opposing wall. As in the first embodiment, a pair of pipe ramps 368, 370 are mounted on the struts at the top of either wall. Shoes 372, 374 are provided for pivotally attaching a front leg to the base. Shoes 372, 374 are at the forward end of the base between I-beams 366, 367. Shoes 373, 375 are provided between the I-beams for attaching rams for lifting the front leg.

Included in base 356 is a beam 376. Beam 376 is located at the rear of the base and is centered between sidewalls 358, 360 and has its longitudinal axis parallel to the walls.

As in the first embodiment, a pair of rails 378, 380 extend along substantially all of each sidewall to provide support for a trough (not shown). At the rear of the base, cabinets, indicated generally at 382, 384, are provided for storing an hydraulic fluid reservoir and associated controls. Shoulders 386, 388 are formed along the inner side of cabinets 382, 384, respectively. Shoulder 386 is in alignment with rail 380 whereas shoulder 388 aligns with rail 378 to provide continuous support, between the shoulders and the rails, for a trough (not shown).

Shoes 390, 392 are provided for pivotally attaching a rear leg, like the rear leg illustrated in the first embodiment, to the base.

Figure 29:
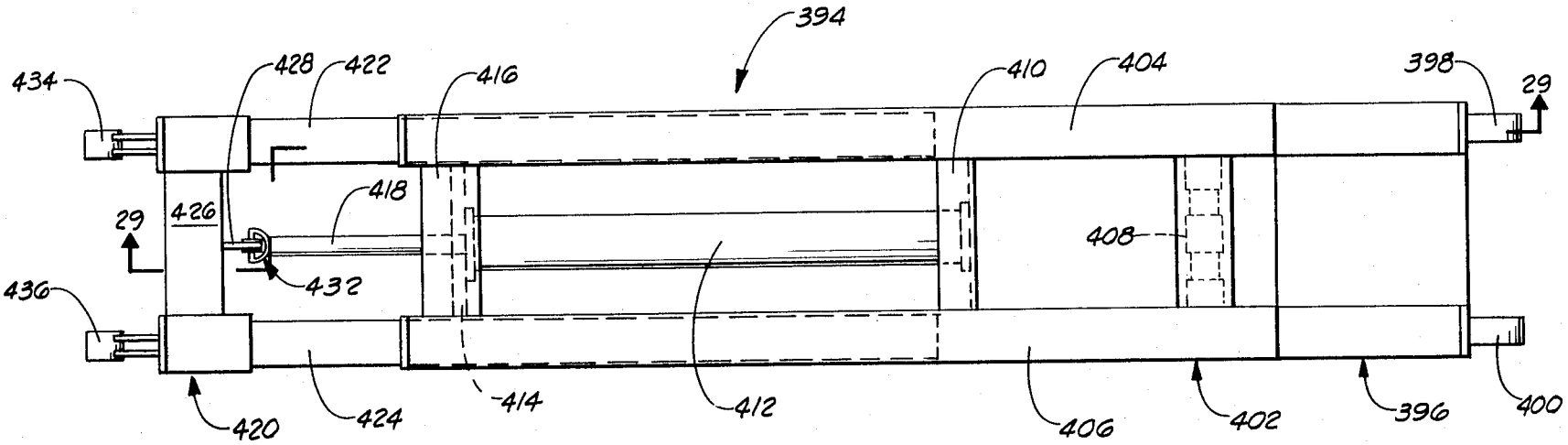
FIG. 29 is a view taken along line 29—29 in FIG. 28.
Figure 29:
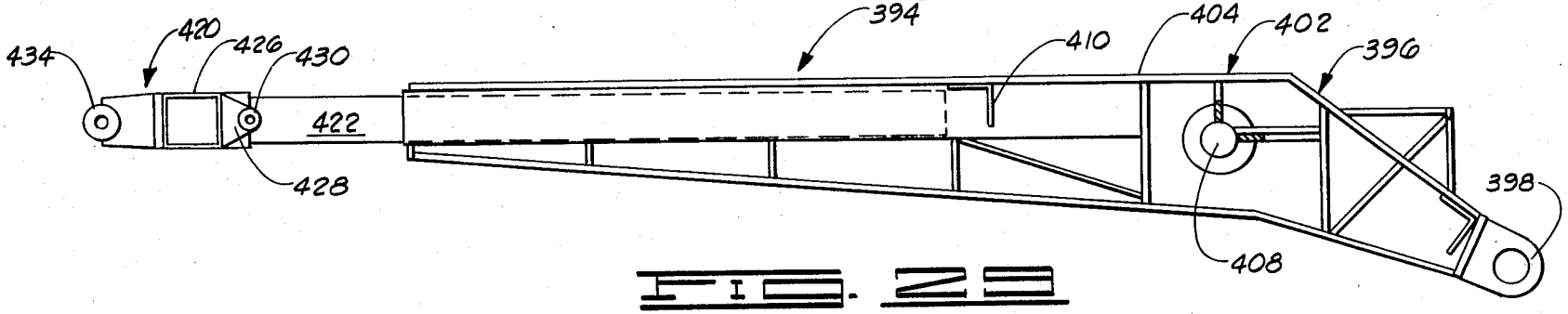
Figure 10:
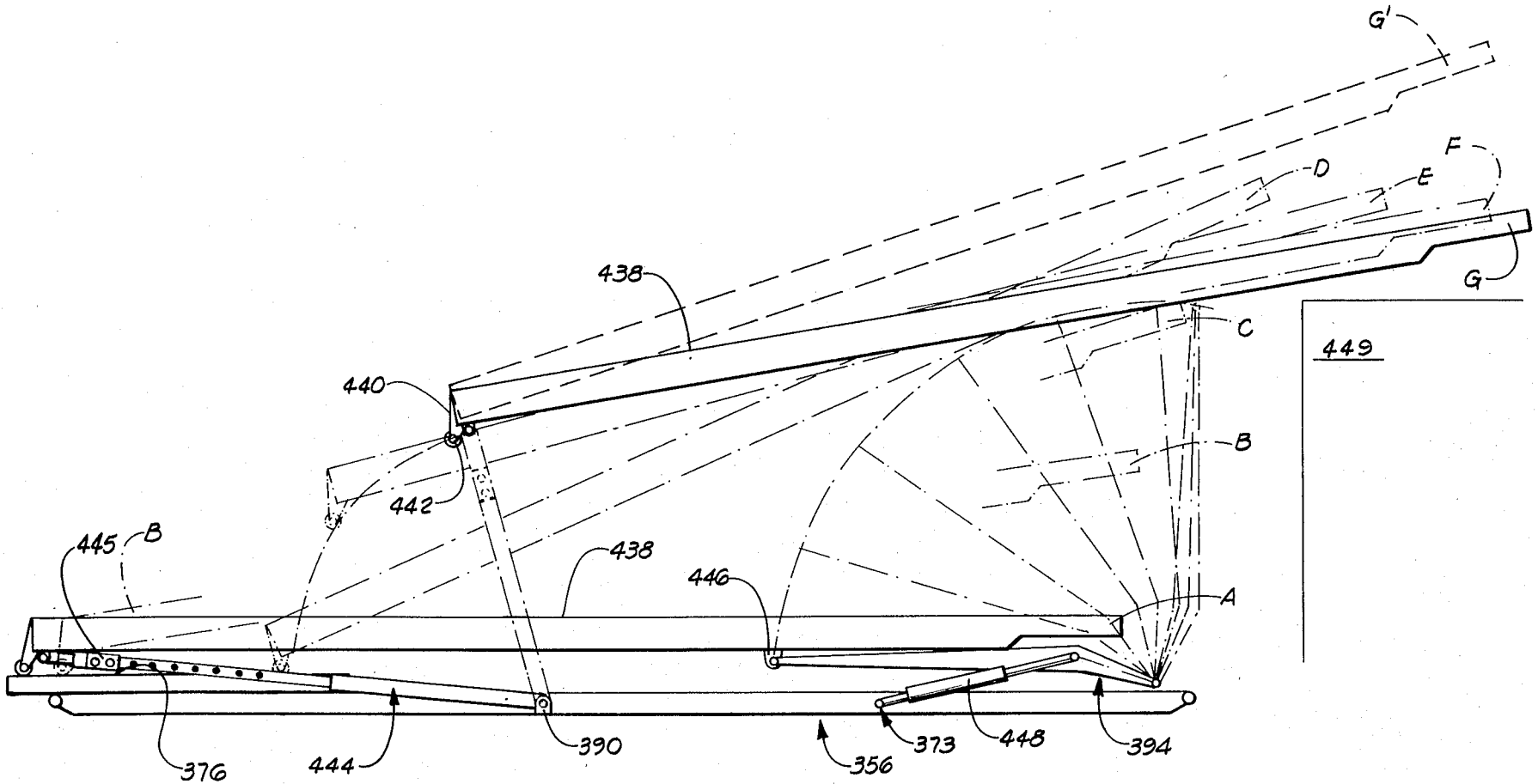

Indicated generally at 394 in FIG. 28 is a front leg for use with the second embodiment of the invention. The leg includes a first portion 396 having eyes 398, 400 at one end thereof. The other end of the lower portion is joined to a second portion 402. Second portion 402 includes a pair of opposing elongate members 404, 406. A shaft 408 is mounted between members 404, 406. An angle plate 410 is likewise mounted between the members and provides a support for the lower end of a ram 412 (not shown in FIG. 29) which is mounted on angle plate 410. The upper end of ram 412 is mounted against a plate 414 which is mounted between a pair of plates, one of which is plate 416. A hole in plate 414 is provided to permit a rod 418 to extend through the hole above plate 414. An extensible portion 420 includes a pair of beams 422, 424 which are telescopingly received within members 404, 406. A cross-piece 426 connects beams 422, 424. A plate 428 having an eye 430 extends from cross-piece 426 toward ram 412. Ram rod 418 is engaged with an eye 430 by means of a conventional clevice 432. Beams 422, 424 include eyes 434, 436, respectively at each of their upper ends.

FIG. 30 illustrates, in a partially schematic manner, the structure and movement of the second embodiment of the invention. Included therein is a trough 438 which is similar in structure and in function to the trough in the first embodiment of the invention. The trough includes ejecting arms, a pipe carrier and a stop bar as in the first embodiment. Trough 438 includes at its rear end a plate 440 having a wheel 442 extending therefrom.

Figure 25:
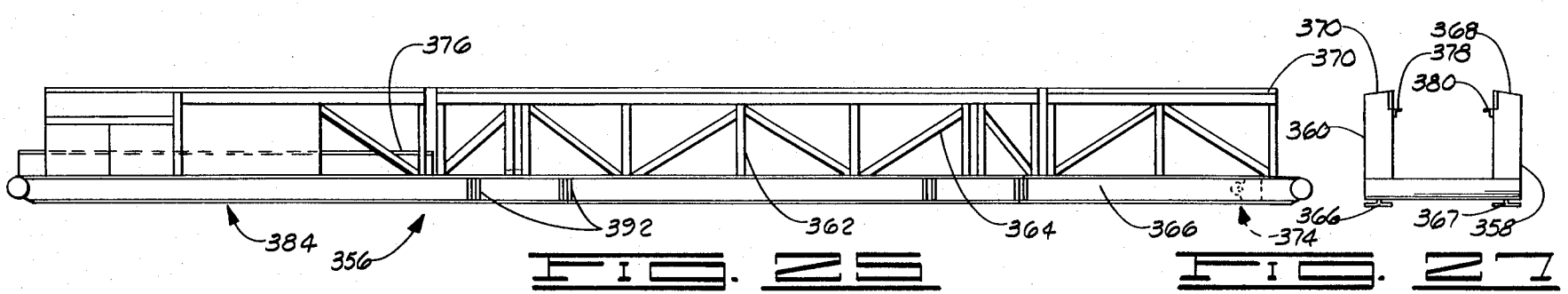
FIG. 25 is a rear elevation view of the view of FIG. 23.

A rear leg 444 is pivotally attached to base 356 at shoes 392. Rear leg 444 is substantially identical to the rear leg of the first embodiment of the invention and includes a stop means or collar 445 as in the first embodiment. Front leg 394 is pivotally attached to base 356 at shoes 372, 374 (in FIGS. 24 and 25) via eyes 398, 400, respectively (in FIG. 28). The other end of leg 394 is pivotally attached to the trough via eyes 434, 436 in the leg and shoes, one of which is shoe 446, mounted on the trough.

A pair of rams, one of which is 448 is pivotally attached to shaft 408 on the front leg at one end and to shoes 373, 375, on the base at the other end. A typical drilling rig platform 449 is located adjacent the machine. Letters A, B, C, D, E, F, G are used to designate various positions of trough 14 during the course of its movement from resting on the base in position A to its raised position.

It is to be appreciated that base 356 includes pipe racks mounted on the base as well as loading arms as in the first embodiment. The view of FIG. 30 is somewhat schematic and is shown without the side walls of the base in order to permit viewing of the front and rear legs as well as ram 448 in position when the trough is lowered.

When it is desired to raise pipe to the top of platform 449, loading arms lift pipe off the rack into the pipe trough as in the first embodiment. When fluid is introduced into ram 448, front leg 394 begins to pivot upwardly about the front end of the base. The front portion of the trough is raised due to lifting action on shoe 446 on the trough. In addition, the rear end of the trough begins forward movement with wheel 442 rolling along beam 376, such rolling of the rear end as well as lifting and forward movement of the front end continuing until position D is reached. When position D is reached, collar 445 on the rear leg strikes the lower portion of the leg and further inward telescoping of the rear leg is prevented. The rear leg thus begins upward pivoting about shoes 390, 392 toward its uppermost condition, position G. When ram 448 is fully extended, the trough is in position G over platform 449. If the machine is in use with a platform having a different height, fluid may be introduced into ram 412 (not shown in FIG. 30) on the front leg in order to extend the ram thus lifting members 442, 424 to a more extended condition for placing the trough in position G'.

Lowering of the machine moves the trough through the same positions it passed through in its upward travel only in reverse order. When in position D, the wheel again contacts beam 376 and the trough begins rearward rolling along the beam until it has resumed its lowermost position, position A.

It is to be appreciated that additions and modifications may be made to the instant embodiments of the invention without departing from the spirit thereof as defined in the following claims.

We claim:

1. In a trough for use in transporting pipe between upper and lower positions of the type having means for unloading pipe at a lower position, apparatus for positioning the pipe along the trough, said apparatus comprising:

an upper and lower channels mounted lengthwise along each side of the trough;

sprocket means rotatably mounted at each end of the channels;

power means operatively connected to said sprocket means for selectively rotating the same;

chain means having an upper run contained in said upper channel and a lower run contained within said lower channel, said chain means being operatively engaged with said sprocket means;

a pipe carrier for receiving one end of a pipe, said carrier being received in the trough;

carrier support means extending downwardly from said pipe carrier;

roller means rotatably mounted on said carrier support means, said roller means being received within said upper channel and further being in rolling engagement with said channel; and means for connecting said chain means to said carrier support means.

2. The apparatus of claim 1 wherein said upper and lower channels are mounted on one side of the trough and said apparatus further includes:

second upper and lower channels mounted lengthwise along the other side of the trough;

second chain means having an upper run contained within said second upper channel and a lower run contained within said second lower channel, said second chain means being operatively engaged with said sprocket means;

second carrier support means extending downwardly from said pipe carrier;

second roller means rotatably mounted on said second carrier support means, said second roller means being received within said second upper channel and further being in rolling engagement with said second channel; and second means for connecting said second chain means to said second carrier support means.

3. The apparatus of claims 1 or 2 wherein the front of said pipe carrier includes a beveled edge.

4. The apparatus of claim 2 wherein said trough and said pipe carrier have an interior V-shaped cross-section and exterior horizontal wings.

5. The apparatus of claim 4 wherein said channels are mounted adjacent said trough wings and wherein said carrier support means extend downwardly from the lower side of said pipe carrier wings.

6. The apparatus of claim 1 wherein said upper channel includes upper and lower portions having facing surfaces, said upper portion having a slot formed therein through which said carrier support means extends and said roller means bears against said facing surfaces.

7. The apparatus of claim 1 wherein said pipe carrier includes an upper portion which covers the end of a pipe received within said carrier.

8. The apparatus of claim 7 wherein said apparatus further includes means for ejecting the pipe end from the pipe carrier to permit pipe unloading.

9. The apparatus of claim 8 wherein said means for ejecting the pipe end comprises:

extension means mounted on said pipe carrier for slidable movement along the longitudinal axis of the trough, said extension means including a portion for abutting a pipe received in said pipe carrier; and stop means mounted on said trough for engagement with said extension means, such engagement sliding said extension means to move such a pipe along the longitudinal axis of the trough until the pipe end is no longer covered by said upper portion.

10. The apparatus of claim 9 wherein said stop means comprises a bar detachably mounted across the trough, said bar being mountable at a selected location along the trough.

11. The apparatus of claim 9 wherein said pipe carrier includes an actuator for switching a switch mounted on said stop means, said switch deactivating said power means when switched.

12. The apparatus of claim 9 wherein said extension means comprises a tubular portion mounted on a planar portion, the longitudinal axis of said tubular portion being substantially perpendicular to said planar portion.

13. The apparatus of claim 12 wherein said pipe carrier further includes a hole formed therein for receiving said tubular portion of said extension means.

14. In a pipe trough for transporting pipe between upper and lower positions:

an elongate body having a V-shaped cross-section;

a pipe carrier having a V-shaped cross-section, said carrier being received within said trough body and longitudinally slidable therealong, said carrier further being constructed to receive one end of the pipe;

a roller mounted on one end of said trough body for supporting the other end of a pipe received within said carrier;

power means for selectively moving said carrier along the length of said trough body;

wherein said trough body includes an upper channel mounted along each side thereof and a lower channel mounted beneath each of said upper channels; and wherein said power means includes:

carrier support means mounted on said carrier and extending into each of said channels;

bearing means mounted on said support means and rollingly engaged with said channels; and power chain means having a chain run in each channel, said chain means being mounted on a shaft and sprocket at each end of said trough body and further being fixedly attached to said carrier support means.

15. In a trough for use in transporting pipe between upper and lower positions of the type having means for unloading pipe at a lower position, apparatus for positioning pipe along the trough, said apparatus comprising:

first upper and lower channels mounted lengthwise along one side of the trough;

second upper and lower channels mounted lengthwise along the other side of the trough;

sprocket means rotatably mounted at each end of said channels;

power means operatively connected to said sprocket means for selectively rotating the same;

first chain means having an upper run contained in said first upper channel and a lower run contained within said first lower channel, said first chain means being operatively engaged with said sprocket means;

second chain means having an upper run contained in said second upper channel and a lower run contained within said second lower channel, said second chain means being operatively engaged with said sprocket means;

a pipe carrier for receiving one end of a pipe, said carrier being received in the trough;

first and second carrier support means extending downwardly from said pipe carrier;

roller means rotatably mounted on said carrier support means, said roller means being received within each of said upper and lower channels and further being in rolling engagement therewith;

first means for connecting said first chain means to said first carrier support means; and second means for connecting said second chain means to said second carrier support means.

16. The apparatus of claim 15 wherein the front edge of said pipe carrier includes a beveled edge.

17. The apparatus of claim 15 wherein said trough and said pipe carrier have an interior V-shaped cross-section and exterior horizontal wings.

18. The apparatus of claim 17 wherein said channels are mounted on said trough wings and wherein said carrier support means extend downwardly from the lower side of said pipe carrier wings.

19. In a trough for use in transporting pipe between upper and lower positions of the type having means for unloading pipe at a lower position, apparatus for positioning the pipe along the trough, said apparatus comprising:

upper and lower channels mounted lengthwise along one side of the trough;

sprocket means rotatably mounted at each end of the channels;

power means operatively connected to said sprocket means for selectively rotating the same;

chain means having an upper run contained in said upper channel and a lower run contained within said lower channel, said chain means being operatively engaged with said sprocket means;

a pipe carrier for receiving one end of a pipe, said carrier including an upper portion which covers the end of a pipe received within said carrier, said carrier being received in the trough;

means for ejecting the pipe end from the pipe carrier to permit pipe unloading, said ejecting means comprising:

extension means mounted on said pipe carrier for slidable movement along the longitudinal axis of the trough, said extension means including a portion for abutting a pipe received in said pipe carrier; and stop means mounted on said trough for engagement with said extension means, such engagement sliding said extension means to move such a pipe along the longitudinal axis of the trough until the pipe end is no longer covered by said upper portion;

wherein said stop means comprises a bar detachably mounted across the trough, said bar being mountable at a selected location along the trough;

carrier support means extending downwardly from said pipe carrier;

roller means rotatably mounted on said carrier support means, said roller means being received within said upper channel and further being in rolling engagement with said channel; and means for connecting said chain means to said carrier support means.

* * * * *

UNITED STATES PATENT AND TRADEMARK OFFICE

CERTIFICATE OF CORRECTION

PATENT NO. : 4,494,899

DATED : January 22, 1985

INVENTOR(S) : Tan Hoang and James B. Smiley

It is certified that error appears in the above-identified patent and that said Letters Patent is hereby corrected as shown below:

In column 6, line 3, change "224" to --223--.

In column 6, line 5, change "223" to --224--.

Signed and Sealed this

*Ninth* Day of *July 1985*

[SEAL]

*Attest:*

DONALD J. QUIGG

*Attesting Officer* *Acting Commissioner of Patents and Trademarks*